US010094273B2

(12) United States Patent
Andersson et al.

(10) Patent No.: US 10,094,273 B2
(45) Date of Patent: Oct. 9, 2018

(54) INTERNAL COMBUSTION ENGINE

(71) Applicant: VOLVO TRUCK CORPORATION, Göteborg (SE)

(72) Inventors: Arne Andersson, Mölnlycke (SE); Bincheng Jiang, Göteborg (SE); Staffan Lundgren, Hindås (SE); Staffan Johansson, Göteborg (SE); Bengt Johansson, Lund (SE)

(73) Assignee: Volvo Truck Corporation, Göteborg (SE)

( * ) Notice: Subject to any disclaimer, the term of this patent is extended or adjusted under 35 U.S.C. 154(b) by 141 days.

(21) Appl. No.: 15/106,184

(22) PCT Filed: Dec. 19, 2013

(86) PCT No.: PCT/EP2013/003852
§ 371 (c)(1),
(2) Date: Jun. 17, 2016

(87) PCT Pub. No.: WO2015/090340
PCT Pub. Date: Jun. 25, 2015

(65) Prior Publication Data

US 2016/0333776 A1 Nov. 17, 2016

(51) Int. Cl.
*F02G 3/00* (2006.01)
*F02B 41/06* (2006.01)
(Continued)

(52) U.S. Cl.
CPC ..... *F02B 41/06* (2013.01); *F02B 33/22* (2013.01); *F02B 75/225* (2013.01); *F02B 2075/025* (2013.01); *F02B 2075/027* (2013.01)

(58) Field of Classification Search
CPC ..... F02B 41/06; F02B 33/22; F02B 75/225; F02B 2075/025; F02B 2075/027
(Continued)

(56) References Cited

U.S. PATENT DOCUMENTS 3,043,283 A * 7/1962 Vitale ..... F02B 75/246 123/52.3
4,783,966 A 11/1988 Aldrich
(Continued)

FOREIGN PATENT DOCUMENTS

CN 1533471 A 9/2004
CN 101418716 A 4/2009
(Continued)

OTHER PUBLICATIONS

International Search Report (dated Aug. 25, 2014) for corresponding International App. PCT/EP2013/003852.
Chinese Official Action (dated Apr. 2, 2018) for corresponding Chinese App. 20130081787.2.

*Primary Examiner* — Marguerite McMahon
(74) *Attorney, Agent, or Firm* — WRB-IP LLP

(57) ABSTRACT

An internal combustion engine including a first set of cylinders includes: a first two-stroke compression cylinder housing a first compression piston connected to a first crank shaft; an intermediate two-stroke compression cylinder housing an intermediate compression piston, wherein the second two-stroke compression cylinder is configured to receive compressed gas from the first two-stroke compression cylinder; and a first four-stroke combustion cylinder housing a first combustion piston, wherein the first four-stroke combustion cylinder is configured to receive compressed gas from the intermediate two-stroke compression cylinder; wherein the internal combustion engine further includes a second set of cylinders including: a second two-stroke compression cylinder housing a second compression piston connected to the first crank shaft, wherein the second two-stroke compression cylinder is configured to provide compressed gas to the intermediate two-stroke compression cylinder; and a second four-stroke combustion cylinder housing a second combustion piston, wherein the second four-stroke combustion cylinder is configured to
(Continued)

receive compressed gas from the intermediate two-stroke compression cylinder; wherein each one of the intermediate compression piston and the first and second combustion pistons are connected to a second crank shaft, the second crank shaft being configured to rotate with a speed of at least twice the speed of the first crank shaft.

16 Claims, 7 Drawing Sheets

(51) Int. Cl.
*F02B 33/22* (2006.01)
*F02B 75/22* (2006.01)
*F02B 75/02* (2006.01)

(58) Field of Classification Search
USPC ..... 123/70 r, 52.3
See application file for complete search history.

(56) References Cited

U.S. PATENT DOCUMENTS

| | | | | |
|---|---|---|---|---|
| 6,318,310 | B1 | 11/2001 | Clarke | |
| 9,803,541 | B2 * | 10/2017 | Andersson | F02B 41/08 |
| 2010/0300385 | A1 | 12/2010 | Durrett et al. | |
| 2011/0303202 | A1 * | 12/2011 | Moser | F02B 41/06 123/65 R |
| 2013/0199492 | A1 * | 8/2013 | Gopalakrishnan | F02B 33/22 123/254 |

FOREIGN PATENT DOCUMENTS

| | | | |
|---|---|---|---|
| DE | 10311776 | A1 | 10/2004 |
| GB | 2 062 748 | A | 5/1981 |
| RU | 2221152 | C2 | 1/2004 |
| WO | 99/06682 | A2 | 2/1999 |

* cited by examiner

INTERNAL COMBUSTION ENGINE

BACKGROUND AND SUMMARY

The present invention relates to an internal combustion engine. The invention is applicable on vehicles, in particularly heavy vehicles, such as e.g. trucks. However, although the invention will mainly be described in relation to a truck, the internal combustion engine is of course also applicable for other type of vehicles, such as cars, industrial construction machines, wheel loaders, etc.

For many years, the demands on internal combustion engines have been steadily increasing and engines are continuously developed to meet the various demands from the market. Reduction of exhaust gases, increasing engine efficiency, i.e. reduced fuel consumption, and lower noise level from the engines are some of the criteria that becomes an important aspect when choosing vehicle engine.

Furthermore, in the field of trucks, there are applicable law directives that have e.g. determined the maximum amount of exhaust gas pollution allowable. Still further, a reduction of the overall cost of the vehicle is important and since the engine constitutes a relatively large portion of the total costs, it is natural that also the costs of engine components are reduced.

In order to meet the described demands, various engine concepts have been developed throughout the years where conventional power cylinders have been combined with e.g. a pre-compression stage and/or an expansion stage.

WO 99/06 682 describes an internal combustion compound engine that aims at providing a relatively light-weighted engine. The internal combustion compound engine disclosed in WO 99/06 682 comprises a first-stage four-stroke combustion unit and a second-stage two-stroke expansion unit. One or more of the first-stage cylinders have pistons driving a first crankshaft and the same number of second-stage expansion cylinders has pistons driving a parallel crankshaft. The second-stage unit can also be arranged as a double-acting cylinder where one side acts as the second expansion stage while the other acts as a pre-compressor or supercharger.

The internal combustion compound engine disclosed in WO 99/06 682 has the advantages of being able to save energy during compression, and thus increasing filet efficiency. The engine may also save and provide reserve energy in the form of compressed air during braking and downhill driving.

Although the internal combustion compound engine described in WO 99/06 682 may increase fuel efficiency as well as saving and providing reserve energy, the engine is still in need of further improvements in terms of e.g. power efficiency and cost.

It is desirable to provide an internal combustion engine having increased power efficiency in relation to prior art engines.

According to a first aspect of the present invention there is provided an internal combustion engine comprising a first set of cylinders comprising: a first two-stroke compression cylinder housing a first compression piston connected to a first crank shaft; an intermediate two-stroke compression cylinder housing an intermediate compression piston, wherein the intermediate two-stroke compression cylinder is configured to receive compressed gas from the first two-stroke compression cylinder; and a first four-stroke combustion cylinder housing a first combustion piston, wherein the first four-stroke combustion cylinder is configured to receive compressed gas from the intermediate two-stroke-compression cylinder; wherein the internal combustion engine further comprises a second set of cylinders comprising: a second two-stroke compression cylinder housing a second compression piston connected to the first crank shaft, wherein the second two-stroke compression cylinder is configured to provide compressed gas to the intermediate two-stroke compression cylinder; and a second four-stroke combustion cylinder housing a second combustion piston, wherein the second four-stroke combustion cylinder is configured to receive compressed gas from the intermediate two-stroke compression cylinder; wherein each one of the intermediate compression piston and the first and second combustion pistons are connected to a second crank shaft, the second crank shaft being configured to rotate with a speed of at least twice the speed of the first crank shaft.

A compression cylinder should in the following and throughout the entire description be interpreted as a cylinder housing a compression piston, where the cylinder is arranged to provide compressed intake gas to another cylinder. In the present invention, the first and second compression cylinders provide compressed gas to the intermediate compression cylinder. The intermediate compression cylinder in turn compresses the gas even further before providing the compressed gas to each of the first and second combustion cylinders. Accordingly, the compression piston compresses gas inside the compression cylinder, which compressed gas thereafter is transferred to the intake of either a further compression cylinder or to a combustion cylinder. The pressure level of the compressed gas is then above atmospheric pressure. The compression cylinders each work in a two-stroke fashion, meaning that when the respective compression piston is in an upper end position of the cylinder, also known as a top dead centre of the cylinder, gas is provided into the cylinder during the downward motion of the compression piston to a lower end position of the compression cylinder, also known as a bottom dead centre of the cylinder. When the compression piston thereafter is in an upward motion towards the upper end position of the cylinder, the gases provided into the cylinder is compressed due to the volume reduction within the cylinder caused by the reciprocating motion of the compression piston. At a desired point in time, the compressed gases are directed out from the compression cylinder and to the intake of the combustion cylinder. A further description of how this is controlled will be given below.

The combustion cylinders are, as described above, four-stroke combustion cylinders, i.e. they have one power stroke and one exhaust stroke for every two revolution of the second crank shaft. When the combustion piston in the respective combustion cylinders are travelling downwards, towards a bottom dead centre of the respective cylinder, the compressed gas from the compression cylinder is forced into the combustion cylinder. When the combustion piston thereafter is travelling upwards toward a top dead centre of the combustion cylinder, the gases in the combustion cylinder are compressed and ignited at a desired point in time. The combustion piston is thereafter, again, traveling downwards towards the bottom dead centre. Finally, when the combustion piston is travelling upwards, the exhaust gases are directed out from the combustion cylinders. Combustion fuel is provided to the combustion cylinders in a fashion known to the person skilled in the art of four-stroke internal combustion engines and will not be discussed further. The invention is also not limited to any particular kind of fuel.

The present invention is based on the insight that by arranging an intermediate "compression cylinder downstream from the first and the second compression cylinder and upstream the first and second combustion cylinders, the compression in each of the compression cylinder can be reduced by still providing gas to the respective combustion cylinders which is sufficiently compressed. Accordingly, an engine having a three-stage compression is provided. Further, by compressing the gas in several stages with intermediate cooling, which is described thither below, the total compression work of the engine is reduced.

An advantage of the invention is that the three-stage compression increases the efficiency of the internal combustion engine, i.e. the power efficiency of the engine may be increased. By utilizing a three-stage compression, the total compression work by the compression cylinders can be reduced in comparison to the use of e.g. a two-stage compression. Furthermore, by using three compression cylinders instead of two, the individual pressure demands on the respective compression cylinders and compression pistons can be reduced in comparison to having two compression stages, where each compression cylinder may need to be able to handle larger pressure. Also the pressure demand on the first and second compression pistons are relatively low such that the cylinders can be designed with low friction coefficients. Furthermore, by providing an intermediate compression stage in the form of the intermediate compression cylinder, it is possible to arrange the first compression piston with a 90 degree crank angle deviation towards the expander. Hereby, the balancing effects of the internal combustion engine are improved. Still further, by positioning the intermediate two-stroke compression piston on the same crank shaft as the first and second four-stroke combustion pistons, it is sufficient with only one compression cylinder since it can alternatingly deliver compressed gas to the first and the second combustion cylinders.

According to an example embodiment, the internal combustion engine may further comprise a first two-stroke expansion cylinder housing a first expansion piston connected to the first crank shaft, the first two-stroke expansion cylinder being configured to receive exhaust gas from the first four-stroke combustion cylinder; and a second two-stroke expansion cylinder housing a second expansion piston connected to the first crank shaft, the second two-stroke expansion cylinder being configured to receive exhaust gas from the second four-stroke combustion cylinder.

An expansion cylinder should in the following and throughout the entire description be interpreted as a cylinder housing an expansion piston, where the cylinder is arranged to receive exhaust gases from the combustion cylinder and thereafter further provide the exhaust gases out from the expansion cylinder. The first and second expansion cylinders work in a two-stroke fashion, meaning that when the respective expansion piston is in an upper end position of the cylinder, exhaust gas from the combustion cylinder is provided into the expansion cylinder during the downward motion of the expansion piston to a lower end position of the expansion cylinder. Hereby, the exhaust gases are expanded due to the increase of the volume within the cylinder in which the expansion piston is reciprocating. When the expansion piston thereafter is in an upward motion towards the upper end position of the cylinder, the exhaust gases provided into the expansion cylinder are directed out from the expansion cylinder, either directly to the atmosphere, or provided to some sort of gas after treatment system, such as e.g. a catalyst or the like.

An advantage is that the power efficiency of the internal combustion engine may be further increased. The expansion cylinder expands the exhaust gases from the respective combustion cylinders and thereby enables for increased thermodynamic efficiency by recovery of chemical energy and heat from the combustion cylinders.

According to an example embodiment, the first compression piston and the second compression piston may be arranged in a 180 degrees crank angle offset in relation to each other, such that the first compression piston is configured to reach an upper end position within the first compression cylinder when the second compression piston reaches a lower end position within the second compression cylinder.

The wording "crank angle offset" should in the following and throughout the description be interpreted as a rotational difference between crank angles for the different pistons, i.e. the crank angle degrees (CAD) between the pistons on the crank shaft. As an example, the four-stroke combustion pistons have a 720 crank angle cycle while the two-stroke compression and expansion pistons each have a 360 crank angle cycle, respectively.

By arranging the compression pistons with a 180 degrees crank angle offset in relation to each other, the intermediate compression piston, which operates at twice the speed of the first and second compression pistons, will receive compressed gas continuously when the intermediate compression piston is in its top dead centre position. More specifically, the intermediate compression piston will be positioned in its top dead centre position when the first compression is positioned in a mid portion of the first compression cylinder.

According to an example embodiment, the intermediate compression piston and the first combustion piston may be arranged in a 180 degrees crank angle offset in relation to each other, such that the intermediate compression piston is configured to reach an upper end position within the intermediate compression cylinder when the first combustion piston reaches a lower end position within the first combustion cylinder.

Further, the intermediate compression piston may have approximately the same size as the first and second combustion pistons, respectively. Hereby, first order-unbalances arising from the first and second combustion pistons can be at least partially extinguished by the motion and inertia forces of the intermediate compression piston in collaboration with the respective combustion pistons.

According to an example embodiment, the first combustion piston and the second combustion piston may be positioned to reach an upper end position within the respective combustion cylinders approximately simultaneously and in such a way that the first combustion piston is configured to be ignited at an upper end position within the first combustion cylinder when the second combustion piston is in an upper end position of the second combustion cylinder for initiation of intake of fuel therein.

An advantage of providing the combustion pistons in the above manner, i.e. with approximately 360 degrees offset in relation to each other is that a combustion stroke will occur for every revolution of the second crank shaft, thereby providing a continuous engine torque. The internal combustion engine is off course working well with minor deviation from the 360 degrees offset, which should not be construed as an absolute value of the internal relationship between the first and second combustion pistons. Also, the configuration of the cylinders is arranged in such a way that compressed as from the intermediate compression cylinder can alternatingly be provided to either the first or the second combustion cylinders.

According to an example embodiment, the first expansion piston and the second expansion piston may be arranged in a 180 degrees crank angle offset in relation to each other, such that the first expansion piston is configured to reach an upper end position within the first expansion cylinder when the second expansion piston reaches a lower end position within the second expansion cylinder.

The motion of the expansion pistons in the expansion cylinders are thus synchronized with the motion of the respective combustion cylinders.

According to an example embodiment, the first expansion piston and the first compression piston may be arranged in a 90 degrees crank angle offset in relation to each other, such that the first compression piston is configured to reach an upper end position within the first compression cylinder when the first expansion piston is located in a mid-portion within the first expansion cylinder. Hereby, the balancing effects of the internal combustion engine are improved due to the mutual relationship between the motion of the masses for the different pistons and their respective connecting rods. In more detail, by arranging two cylinders in a 90 degree V-shape, wherein pistons sharing the same pin on the crank shaft, it is possible to fully balance first order unbalances from the piston masses with balance weights on the crank shaft.

According to an example embodiment, a first and a second compression con rod may be connected to the first and second compression piston, respectively, and a first and a second expansion con rod may be connected to the first and second expansion piston, respectively, wherein the first compression con rod and the first expansion con rod is connected to a first crank pin of the first crank shaft, and wherein the second compression con rod and the second expansion con rod is connected to a second crank pin of the first crank shaft. Hereby, further control of the mutual motion pattern of the cylinders is provided.

According to an example embodiment, the first and second compression cylinders may be positioned in parallel in relation to each other and the first and second expansion cylinders may be positioned in parallel in relation to each other, wherein the compression cylinders and the expansion cylinders are arranged in a V-shaped configuration in relation to each other.

According to an example embodiment, each of the cylinders may comprise valved inlet ports and valved outlet port for controlling fluid transportation into and out from the respective cylinders.

Hereby, it is possible to control the fluid transportation by opening and closing the valved outlet ports at suitable intervals. For example, the valved outlet ports of the first compression cylinder may be controlled to be in an opened state when the pressure in the first compression cylinder has reached a predetermined pressure limit. Different types of valved ports are well known to the skilled person and will not be described further. The valved ports can be controlled by means of an already available control unit of the engine or vehicle onto which the engine is to be mounted.

According to an example embodiment, each one of the first and second compression cylinders may be arranged in fluid communication with the intermediate compression cylinder by means of a respective first and second passageway. According to an example embodiment, the intermediate compression cylinder may be in fluid communication with the first and second combustion cylinders by means of a respective third and fourth passageway. According to an example embodiment, the first combustion cylinder may be in fluid communication with the first expansion cylinder by means of a fifth passageway. According to an example embodiment, the second combustion cylinder may be in fluid communication with the second expansion cylinder by means of a sixth passageway. Hereby, well defined passages are provided between the cylinders for transportation of gas and/or exhaust gas to/from the respective cylinders.

According to an example embodiment, the first, second, third and/or fourth passageways may be provided with cooling means for cooling the fluid passing there through. Hereby, the power consumption of the internal combustion engine can be reduced since the pressure level of the cooling means can be increased in comparison to previously known engines. An overall lower compression work is provided which improves engine efficiency and durability. A colder internal combustion engine is also provided. The cooling means may e.g. be a heat exchanger or the like.

According to an example embodiment, the first compression cylinder and the second compression cylinder may be one and the same compression cylinder, and the first compression piston and the second compression piston may be one and the same compression piston, wherein the compression cylinder is configured to provide a first compression when the compression piston reaches an upper position within the compression cylinder, and to provide a second compression when the compression piston reaches a lower position within the compression cylinder.

Hereby, instead of using two separate compression cylinders, one compression cylinder, housing a piston that compress gas in both its reciprocating directions, may be sufficient. An advantage is that the overall size of the engine can be reduced and the engine may hence be more cost efficient since less material for the engine is needed. Accordingly, a dual-acting compression cylinder is provided.

According to a second aspect of the present invention, there is provided a vehicle comprising an internal combustion engine according to any one of the above described example embodiments.

Effects and features of this second aspect are largely analogous to those describe above in relation to the first aspect of the present invention.

Further features of and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional features and advantages of the present invention, will be better understood through the following illustrative and non-limiting detailed description of exemplary embodiments of the present invention, wherein.

DETAIL DESCRIPTION

Figure 1:
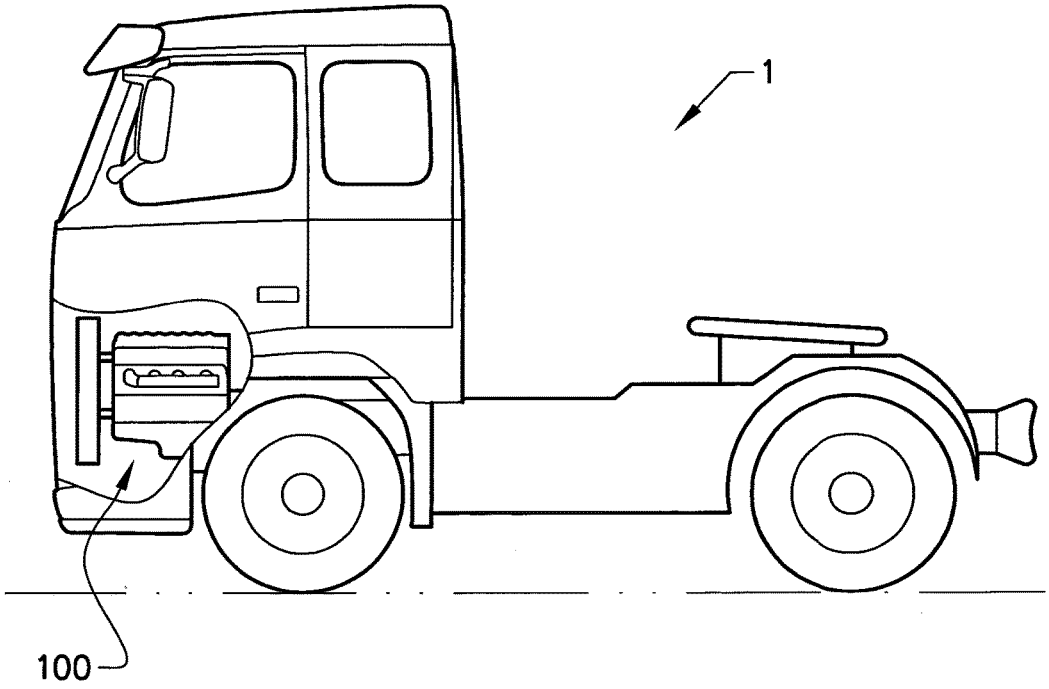
FIG. 1 is a side view of a vehicle comprising an internal combustion engine according to an example embodiment of the present invention.

The present invention will now be described more fully hereinafter with reference to the accompanying drawings, in which exemplary embodiments of the invention are shown. The invention may, however, be embodied in many different forms and should not be construed as limited to the embodiment set forth herein; rather, these embodiments are provided for thoroughness and completeness. Like reference character refer to like elements throughout the description.

With particular reference to FIG. 1, there is provided a vehicle 1 with an internal combustion engine 100 according to the present invention. The vehicle 1 depicted in FIG. 1 is a truck for which the inventive internal combustion engine 100, which will be described in detail below, is particularly suitable for.

Figure 2:
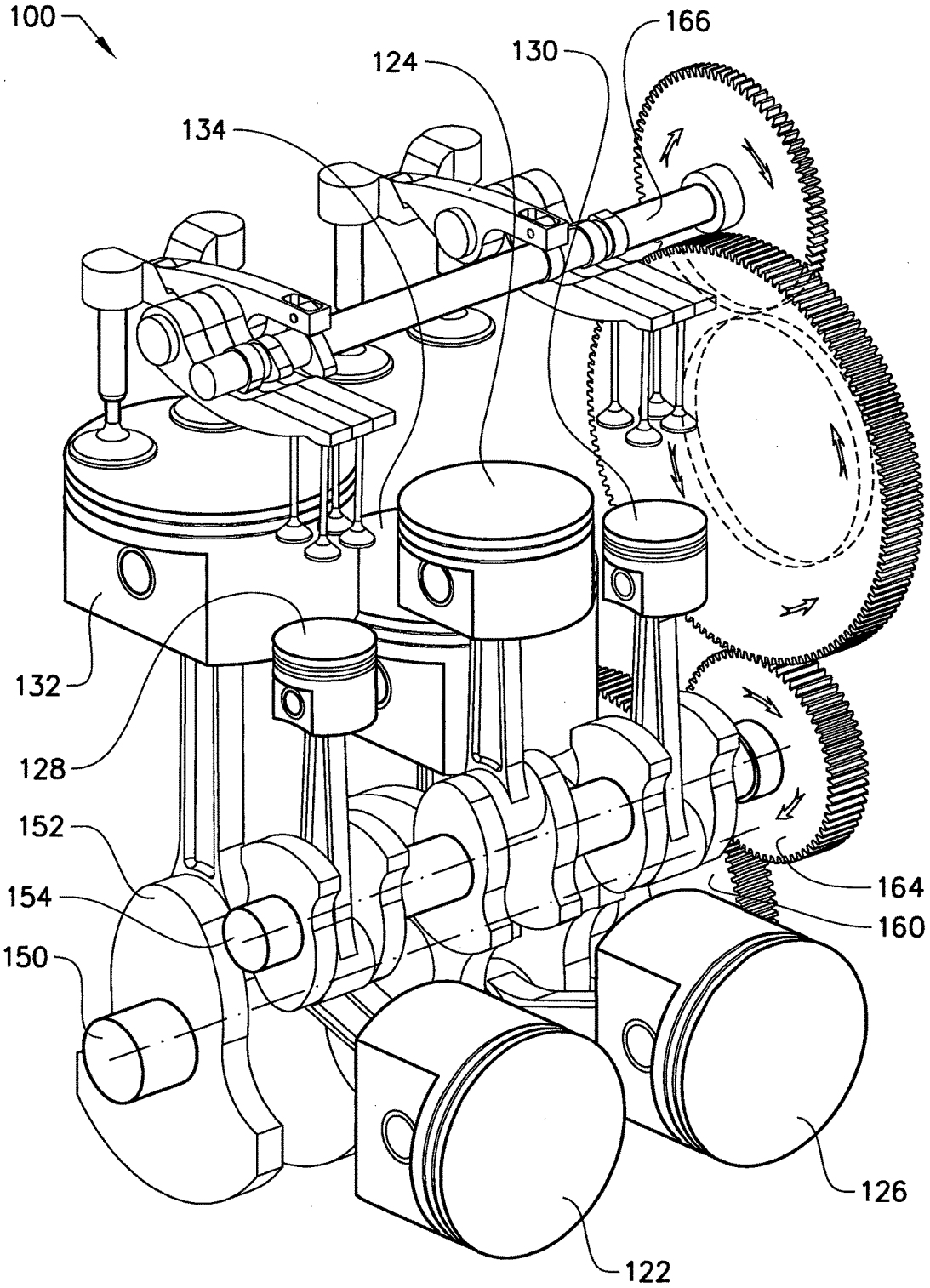
FIG. 2 is a perspective view of the internal combustion engine according to an example embodiment of the present invention.
Figure 3:
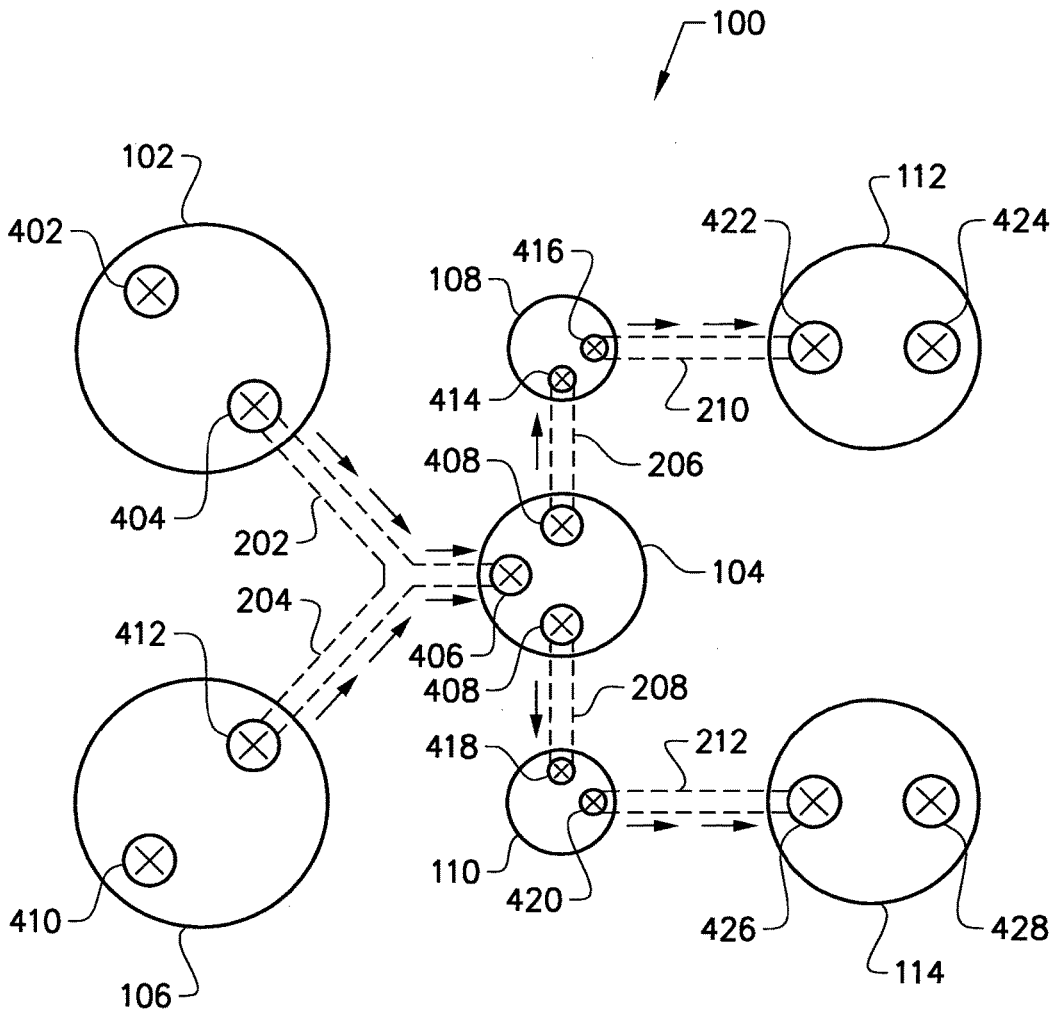
FIG. 3 is a schematic top view of the interconnection between the cylinders in the example embodiment depicted in FIG. 2.

Turning to FIG. 2 in combination with FIG. 3, which illustrate an internal combustion engine 100 according to an example embodiment of the present invention. The cylinders housing the respective piston have been omitted from FIG. 2 for simplicity of understanding the invention and the piston configuration, and can instead be found in the schematic top view of FIG. 3.

The internal combustion engine 100 comprises a first compression cylinder 102 which is in fluid communication with an intermediate compression cylinder 104 by means of a first passageway 202, a second compression cylinder 106 which is in fluid communication with the intermediate compression cylinder 104 by means of a second passageway 204. The intermediate compression cylinder 104 is in turn in fluid communication with a first combustion cylinder 108 by means of a third passageway 206 and in fluid communication with a second combustion cylinder 10 by means of a fourth passageway 208. The first combustion cylinder 108 is further in fluid communication with a first expansion cylinder 112 by means of a fifth passageway 210 and the second combustion cylinder 110 is in fluid communication with a second expansion cylinder 114 by means of a sixth passageway 212. The first 202, second 204, third 206 and the fourth 208 passageways are, in the example embodiment, provided with cooling means (not shown) for cooling the gases transported there through.

Furthermore, the first 102 and second 106 compression cylinder houses a first 122 and a second 126 compression piston, respectively, which both are connected to a first crank shaft 150 by means of a respective connecting rod. The first 112 and second 114 expansion cylinder houses a first 132 and a second 134 expansion piston, respectively, which both are connected to the first crank shaft 50 by means of a respective connecting rod. As depicted in FIG. 2, the first compression piston 122 and the first expansion piston 32 are connected to a first crank pin 152 of the first crank shaft 150 and arranged in 90 degrees configuration in relation to each other. Likewise, the intermediate compression piston 124 and the second expansion piston 134 are connected to a second crank pin of the first crank shaft 150 and also arranged in a 90 degrees configuration in relation to each other. It should be readily understood that the 90 degrees configuration serves as an example embodiment and other configurations are of course conceivable. Furthermore, according to the example embodiment depicted in FIG. 2, the first 122 and second 126 compression pistons are positioned in parallel in relation to each other and the first 132 and the second 134 expansion pistons are positioned in parallel in relation to each other.

Moreover, the above described first 108 and second 110 combustion cylinders houses a first 128 and a second 130 combustion piston, respectively, which are both connected to a second crank shaft 154 by means of a respective connecting rod. Also, the intermediate compression cylinder 104 houses an intermediate compression piston 124 which is also connected to the second crank shaft 154 by means of a connecting rod. The first combustion piston 128, the second combustion piston 130 and the intermediate compression piston 124 are hence arranged in parallel to each other.

The second crank shaft 154 is configured, in the example embodiment, to rotate with a speed of a multiple integer of at least two in comparison to the speed of the first crank shaft 150. The following will, for simplicity of understanding, only describe the case where the second crank shaft 154 rotates with twice the speed of the first crank shaft 150. The compression cylinders 102, 104, 106 and the expansion cylinders 112, 114 are two-stroke cylinders, while the combustion cylinders 108 are 110 are four-stroke cylinders. Hereby, the first 122 and second 126 compression pistons, as well as the first 132 and second 134 expansion pistons will complete a full two-stroke cycle when the first 128 and second 130 combustion cylinders completes a full four-stroke cycle. The intermediate compression piston 124 will hence complete two full two-stroke cycles during the same period.

The first crank shaft 150 is connected to the second crank shaft 154 by means of a suitable transmission. The transmission is in the example embodiment depicted in FIG. 2, a gear transmission having a first gear 160 connected to the first crank shaft 150 and a second gear 162 connected to the second crank shaft 154, wherein the gears are in meshed connection with each other. The engine torque is thereafter transmitted to e.g. a gearbox of the vehicle 1.

Moreover, the transmission is further connected to a cam shaft 166 of the internal combustion engine. The cam shaft controls the various valves, which function will be described below, of the different cylinders. There is one single cam shaft controlling the valves for all cylinders of the internal combustion engine in the example embodiment depicted in FIG. 2. This is achievable due to the mutual speed/stroke configurations of the pistons and their respective crank shafts.

In order to describe the motion pattern of the different cylinders and the communication between the different cylinders during use of the internal combustion engine, reference is made to FIGS. 4 to 7, which illustrate a complete cycle of the internal combustion engine.

Figure 4:
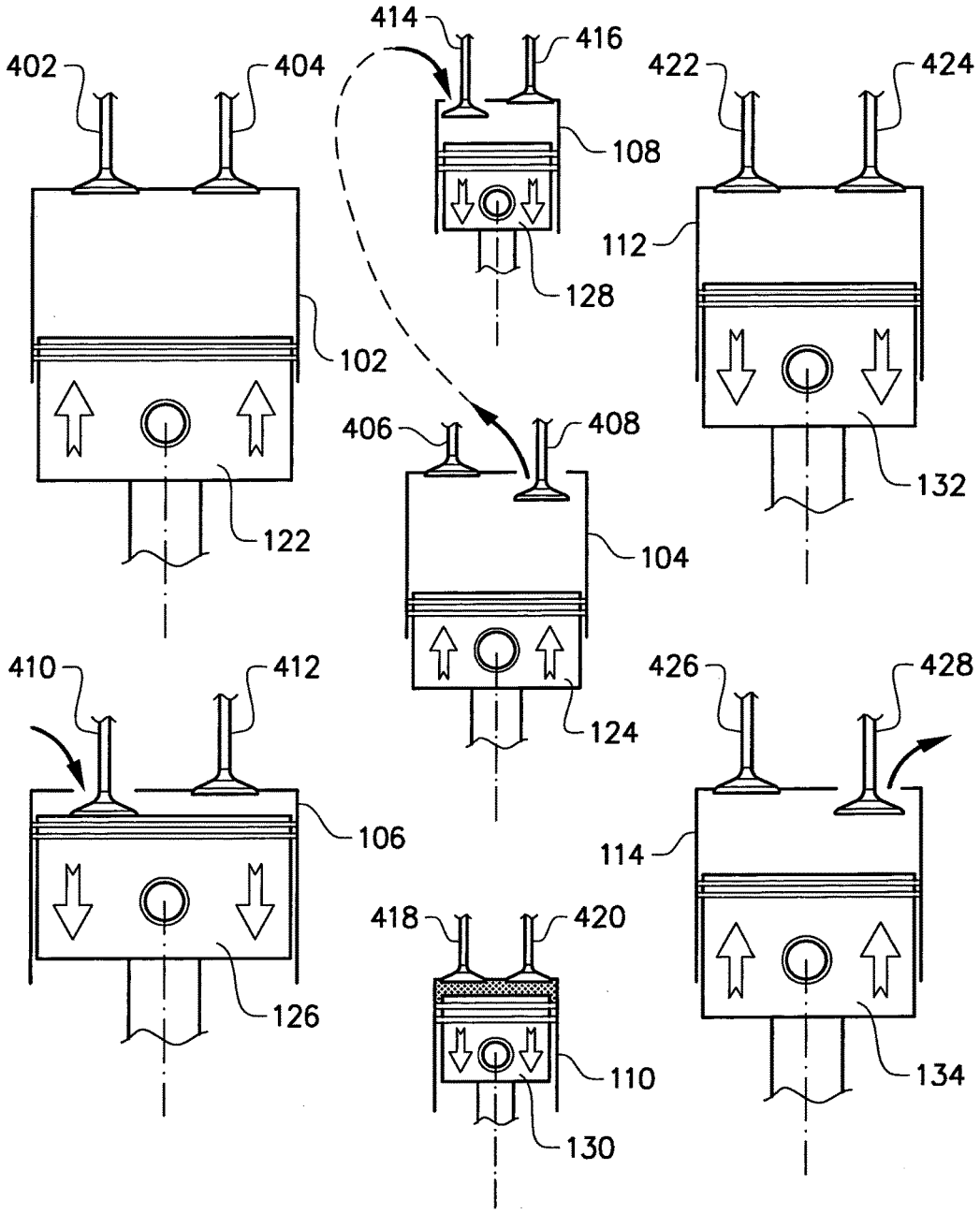
FIGS. 4-7 schematically illustrate the four steps of a complete cycle of the internal combustion engine according to an example embodiment of the present invention.

Starting with FIG. 4, which illustrates a first stage of the cycle, the first compression piston 122 is positioned in a lower end position within the first compression cylinder 102 and in an upward motion towards the upper end position therein. An inlet valve 402 and an outlet valve 404 of the first compression cylinder 102 are both positioned in a closed state.

The intermediate compression piston 124 is positioned in a lower end position within the intermediate compression cylinder 104 and in an upward motion towards an upper end position therein. An inlet valve 406 of the intermediate compression cylinder 104 is positioned in a closed state while an outlet valve 408 of the intermediate compression piston is positioned in an open state to allow compressed gas provided therein to be forced into the first combustion cylinder 108 during the upward motion of the intermediate compression piston 124.

The second compression piston 126 is positioned in an upper end position within the second compression cylinder 106 and in a downward motion towards the lower end position therein. An inlet valve 410 of the second compression cylinder 106 is positioned in an open state allowing gas to enter the second compression cylinder 106 during the downward motion of the second compression piston 126. An outlet valve 412 of the second compression cylinder is positioned in a closed state.

Furthermore, the first combustion piston 128 is positioned in an upper end position within the first combustion cylinder 108 and in a downward motion towards the lower end position therein. An inlet valve 414 of the first combustion cylinder 108 is positioned in an open state to allow compressed gas from the intermediate compression cylinder 104 to be forced into the first combustion cylinder 108 during the downward motion of the first combustion piston 128. An outlet valve 416 of the first combustion cylinder is positioned in a closed state.

Still further, the second combustion piston 130 is positioned in an upper end position within the second combustion cylinder 110 and in a downward motion toward a lower end position therein. An inlet valve 418 and an outlet valve 420 of the second combustion cylinder 110 are both positioned in a closed state. The second combustion cylinder is in this state in a power stroke, i.e. an ignition of the reduced volume within the second combustion cylinder takes place at this stage forcing the second combustion piston 130 downward towards the lower end position within the second combustion cylinder 10.

Moreover, the first expansion piston 132 is positioned in a mid-portion of the first expansion cylinder 112 and in a downward motion towards a lower end position therein. An inlet valve 422 and an outlet valve 424 of the first expansion cylinder are both positioned in a closed state.

Finally, the second expansion piston 134 is positioned in a mid-portion of the second expansion cylinder 114 and in an upward motion towards an upper end position therein. An inlet valve 426 of the second expansion cylinder is positioned in a closed state while an outlet valve 428 of the second expansion cylinder 114 is positioned in an open state to allow expanded exhaust gases provided therein to be expelled out from the second expansion cylinder 114 during the upward motion of the second expansion cylinder 114.

According, to an example embodiment, the first and second expansion cylinders only comprise an outlet valve, respectively, i.e. no inlet valve 422, 426. Hereby, the exhaust gases from the combustion cylinders 108, 110 are provided into the first expansion cylinders 112, 114 via the respective outlet valves 424, 428. Accordingly, the outlet valves 422, 426 each act as inlet valves and as outlet valves for the expansion cylinders.

Figure 5:
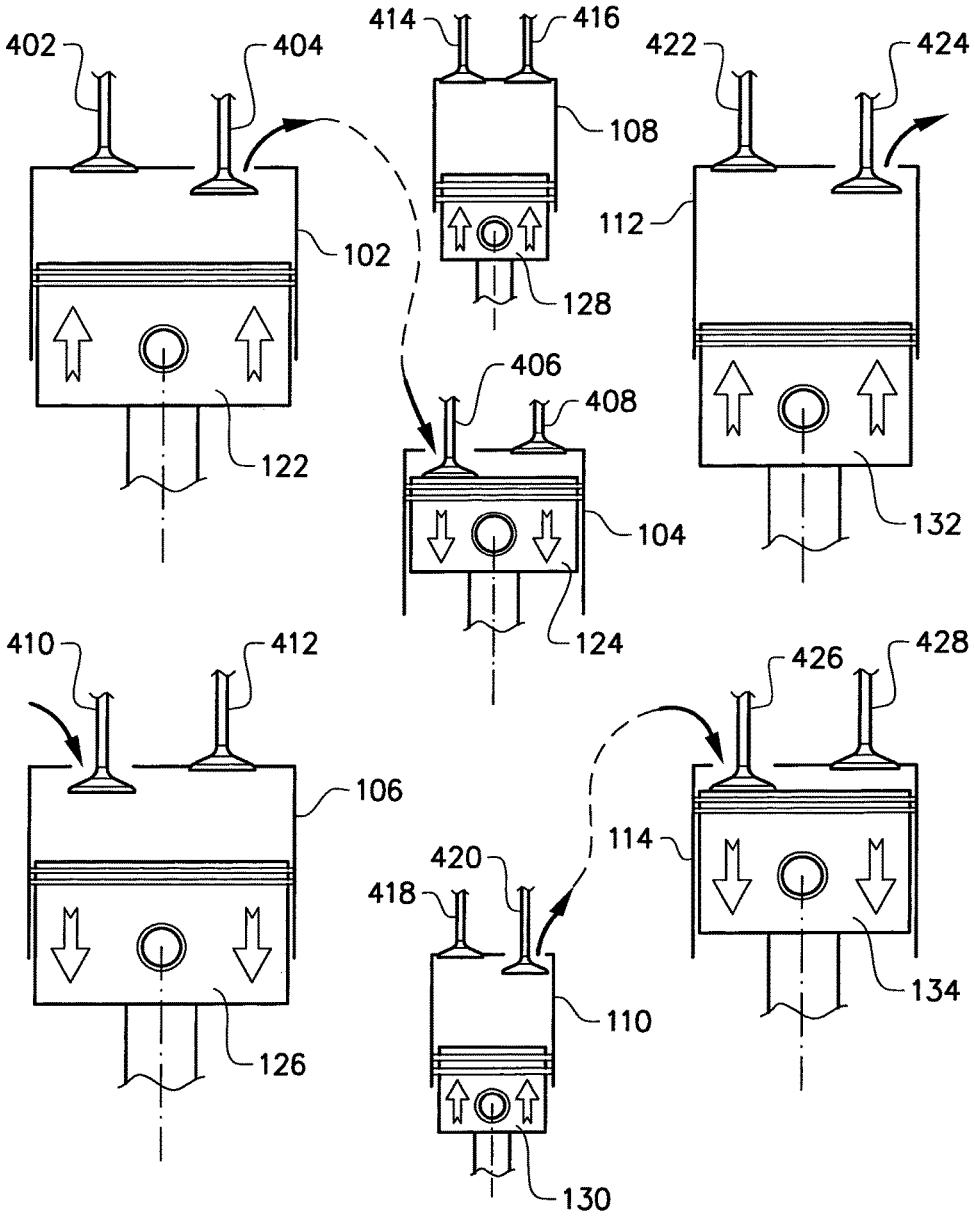

At a second stage of the cycle, illustrated in FIG. 5, the first compression piston 122 is positioned in a mid-portion of the first compression cylinder 102 and still in an upward motion towards the upper end position therein. The inlet valve 402 of the first compression cylinder 102 is positioned in a closed state while the outlet valve 404 is positioned in an open state to allow compressed gas provided within the first compression cylinder 102 to be forced into the intermediate compression cylinder 104 during the upward motion of the first compression piston 122.

The intermediate compression piston 124 is positioned in the upper end position within the intermediate compression cylinder 104 and in downward motion towards the lower end position therein. The inlet valve 406 of the intermediate compression cylinder 104 is positioned in an open state to allow compressed gas from the first compression cylinder 102 to be forced into the intermediate compression cylinder 102 during the downward motion of the intermediate compression piston 124.

Further, the outlet valve 408 of the intermediate compression piston is positioned in a closed state.

Furthermore, the second compression piston 126 is positioned in a midportion of the second compression cylinder 106 and in a downward motion towards the lower end position therein. The inlet valve 410 of the second compression cylinder 106 is still in an open state to further allow gas to enter into the second compression cylinder 106 during the downward motion of the second compression piston 126. The outlet valve 412 of the second compression cylinder 106 is in a dosed state.

Moreover, the first combustion piston 128 is positioned in the lower end position within the first combustion cylinder 108 and in an upward motion towards the upper end position therein. Both the inlet valve 414 and the outlet valve 416 of the first combustion cylinder 108 are in a closed state such that compression of the compressed gases that entered the first combustion cylinder 108 during the above described first stage of the cycle is compressed therein during the upward motion of the first combustion piston 128.

Turning to the second combustion cylinder 110, the second combustion piston 130 therein is positioned in the lower end position and in an upward motion toward the upper end position within the second combustion cylinder 110. The inlet valve 418 of the second combustion cylinder 110 is in a closed state while the outlet valve 420 is in an open state, thereby forcing exhaust gases, produced during the power stroke described above in relation to the first stage of the cycle, into the second expansion cylinder 114 during the upward motion of the second combustion piston 130.

The first expansion piston 132 is positioned in the lower end position within the first expansion cylinder 112 and in an upward motion towards the upper end position therein. The inlet valve 422 of the first expansion cylinder 112 is in a closed state while the outlet valve 424 is in an open state to allow expanded exhaust gases to be expelled out from the first expansion cylinder during the upward motion of the first expansion piston 132.

The second expansion piston 134 is positioned in the upper end position within the second expansion cylinder 114 and in a downward motion towards the lower end position therein. The inlet valve 426 of the second expansion cylinder 114 is positioned in the open state to allow exhaust gases from the second combustion cylinder 110 to be forced therein during the downward motion of the second expansion cylinder 114. The outlet valve 428 of the second expansion cylinder is in a closed state.

Figure 6:
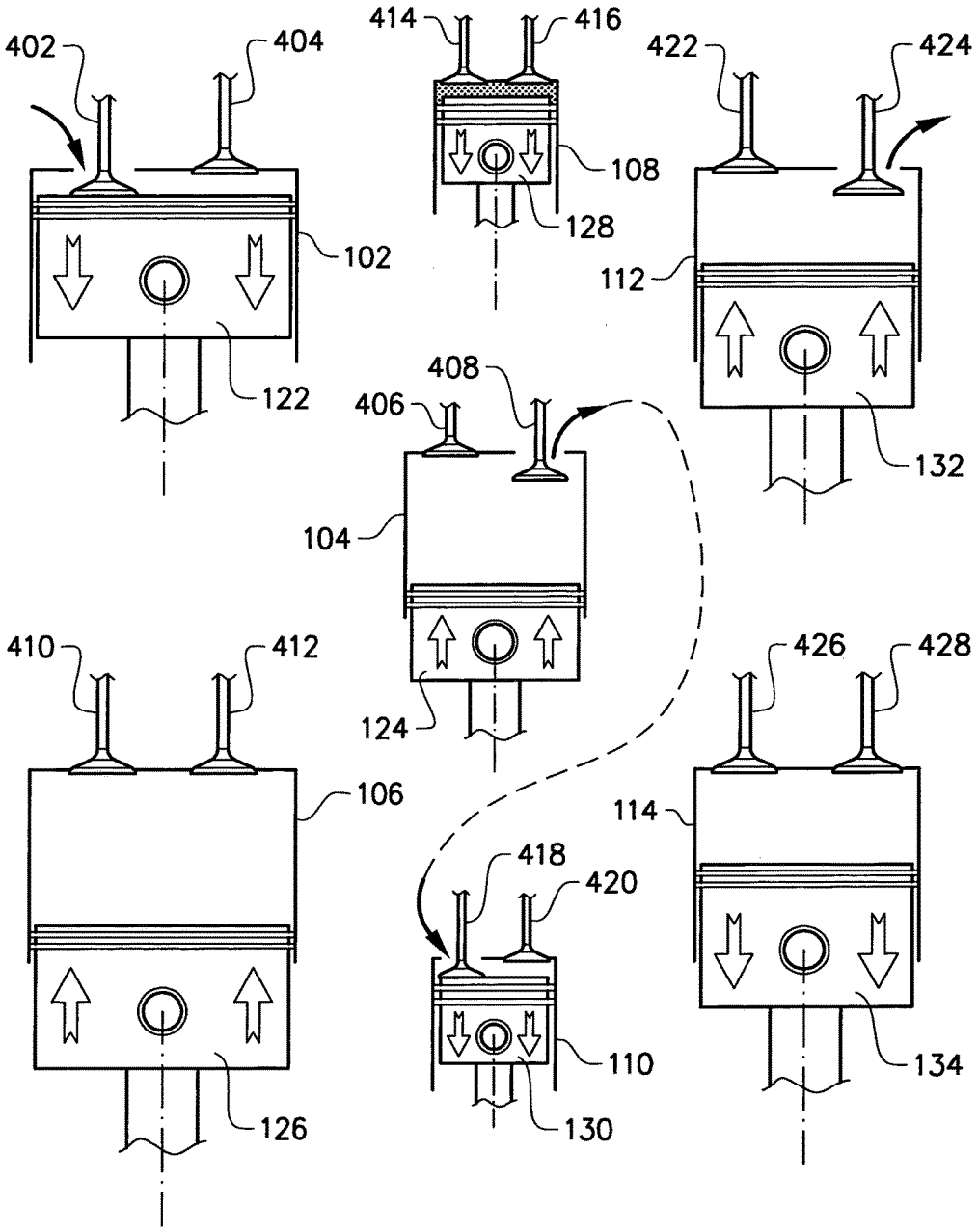

Reference is now made to FIG. 6 in order to describe the third stage of the cycle. Firstly, the first compression piston 122 is positioned in the upper end position within the first compression cylinder 102 and in a downward motion towards the lower end position therein. The inlet valve 402 is positioned in an open state to allow gas to enter the first compression cylinder 102 during the downward motion of the first compression piston 122. The outlet valve 404 of the first compression cylinder 102 is positioned in a closed state.

The intermediate compression piston 124 is positioned in the lower end position within the intermediate compression cylinder 104 and in an upward motion towards the upper end position therein. The inlet valve 406 of the intermediate compression cylinder 104 is positioned in a closed state while the outlet valve 408 is positioned in an open state to allow compressed gas to be forced out from the intermediate compression cylinder 104 and into the second combustion cylinder 110 during the upward motion of the intermediate compression piston 124.

The second compression piston 126 is positioned in the lower end position within the second compression cylinder 106 and in an upward motion towards the upper end position therein. Both the inlet 410 and outlet 412 valves are positioned in a closed state.

Furthermore, the first combustion piston 128 is positioned in the upper end position within the first combustion cylinder 108 and in a downward motion towards the lower end position therein. Both the inlet 414 and the outlet 416 valves are positioned in a closed state and the first combustion cylinder 108 is thus in a power stroke, i.e. an ignition of the reduced volume within the first combustion cylinder 108 takes place at this stage forcing the first combustion piston 128 downward towards the lower end position within the first combustion cylinder 108.

The second combustion piston 130 is positioned in the upper end position within the second combustion cylinder 110 and in a downward motion towards the lower end position therein. The inlet valve 418 of the second combustion cylinder is positioned in an open state to allow compressed gas from the intermediate compression cylinder 104 to enter the second combustion cylinder 110 during the downward motion of the second combustion piston 130. The outlet valve 420 of the second combustion cylinder 110 is positioned in a closed state.

The first expansion piston 132 is positioned in a mid-portion of the first expansion cylinder 112 and in an upward motion towards the upper end position therein. The inlet valve 422 of the first expansion cylinder 112 is positioned in a closed state while the outlet valve 424 is still positioned in an open state to further allow expanded exhaust gas to be expelled out from the first expansion cylinder 112 during the upward motion of the expansion piston 132 towards the upper end position therein.

The second expansion piston 134 is positioned in a mid-portion of the second expansion cylinder 114 and in a downward motion towards the lower end position therein. Both the inlet 426 and the outlet 428 valves are positioned in a closed state and the second expansion cylinder 114 thus, in the downward motion of the second expansion piston 134, expands the exhaust gases forced therein from the second combustion cylinder 110 during the second stage of the cycle.

Figure 7:
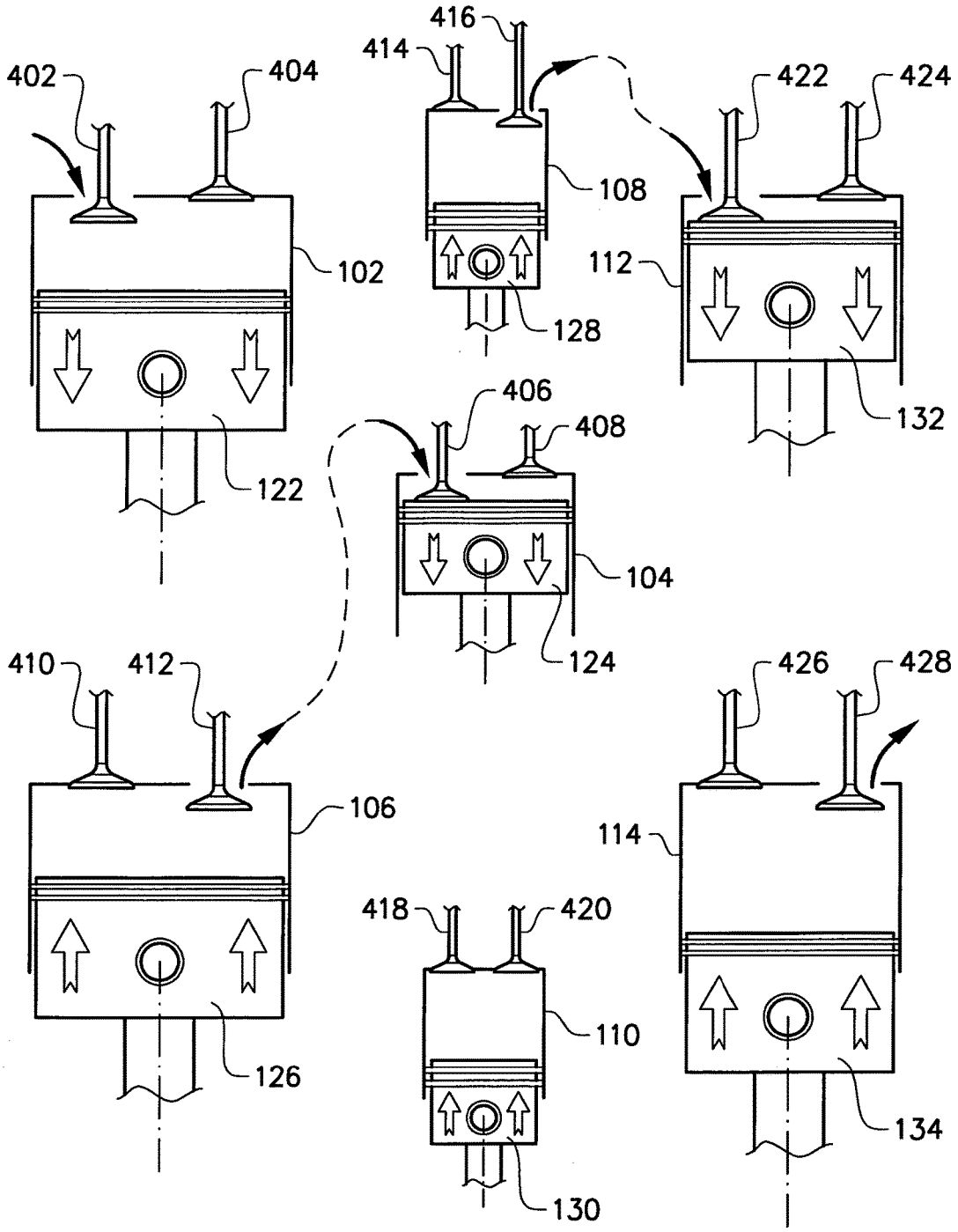

Finally, reference is made to FIG. 7 in order to describe the fourth stage of the cycle. The first compression piston 122 is positioned in the mid-portion of the first compression cylinder 102 and in a downward motion towards the lower end position therein. The inlet valve 402 of the first compression cylinder 102 is still in the open state to further allow gas to enter the first compression cylinder 102 during the downward motion of the first compression piston 122. The outlet valve 404 is positioned in the closed state.

The intermediate compression piston 124 is positioned in the upper end position within the intermediate compression cylinder 104 and in a downward motion towards the lower end position therein. The inlet valve 406 of the intermediate compression cylinder 104 is positioned in the open state to allow compressed gas from the second compression cylinder 106 to be forced into the intermediate compression cylinder 104 during the downward motion of the intermediate compression piston 124. The outlet valve 408 of the intermediate compression cylinder is positioned in the closed state.

The second compression piston 126 is positioned in a mid-portion of the second compression cylinder 106 and in an upward motion towards the upper end position therein. The inlet valve 410 of the second compression cylinder 106 is positioned in the closed state while the outlet valve 412 is positioned in the open state to allow compressed gas in the second compression cylinder 106 to be forced into the intermediate compression cylinder 104 during the upward motion of the second compression piston 126.

Turning to the combustion cylinders, the first combustion piston 128 is positioned in the lower end position within the first combustion cylinder 108 and in an upward motion towards the upper end position therein. The inlet valve 414 of the first combustion piston is positioned in a closed state while the outlet valve 416 is positioned in the open state to allow exhaust gases from the power stroke described above to be forced into the first expansion cylinder 112 during the upward motion of the first combustion piston 128.

The second combustion piston 130 is positioned in the lower end position within the second combustion cylinder 110 and in an upward motion therein. Both the inlet 418 and the outlet 420 valves are positioned in the closed state. The second combustion piston 130 is hence in an initial compression stage within the second combustion cylinder 110.

The first expansion piston 132 is positioned in the upper end position within the first expansion cylinder 112 and in a downward motion towards the lower end position therein. The inlet valve 422 of the first expansion cylinder 112 is positioned in the open state to allow exhaust gases from the second combustion cylinder 108 to be forced therein and expanded during the downward motion of the first expansion piston 132. The outlet valve 424 is positioned in the closed state.

Finally, the second expansion piston 134 is positioned in the lower end position within the second expansion cylinder 114 and in an upward motion towards the upper end position therein. The inlet valve 426 of the second expansion cylinder 114 is positioned in a closed state while the outlet valve 428 of the second expansion cylinder 114 is positioned in the open state to, during the upward motion of the second expansion piston 134, expel the exhaust gases that was expanded in the second expansion cylinder 114 during the third stage described above.

Although FIGS. 5-7 illustrates that combustion gases from the first 108 and second 110 combustion cylinder are forced into the respective expansion cylinders 112, 114 via the inlet valves 422 and 426, the present invention is equally applicable by having expansion cylinder comprising only one valve. Hereby, the valves 422 and 426 are removed and the combustion gases are provided into the respective expansion cylinder via the outlet valves 424 and 428, which still further expels the expanded gases out from the respective expansion cylinders 112, 114.

It is to be understood that the present invention is not limited to the embodiments described above and illustrated in the drawings; rather, the skilled person will recognize that many changes and modifications may be made within the scope of the appended claims. For example, the described opening and closing of the different valves is not strictly limited to the above description, the valve may be arranged in an opened state and in a closed state at either an earlier point in time in relation to the position of the respective piston, or later. Furthermore, it should be readily understood that the gas entering the first or second compression cylinders described above may, for example, be ambient air or other suitable gas.

The invention claimed is:

1. An internal combustion engine comprising a first set of cylinders comprising:

a first two-stroke compression cylinder housing a first compression piston connected to a first crank shaft;

an intermediate two-stroke compression cylinder housing an intermediate compression piston, wherein the intermediate two-stroke compression cylinder is configured to receive compressed gas from the first two-stroke compression cylinder; and a first four-stroke combustion cylinder housing a first combustion piston, wherein the first four-stroke combustion cylinder is configured to receive compressed gas from the intermediate two-stroke-compression cylinder;

wherein the internal combustion engine further comprises a second set of cylinders comprising:

a second two-stroke compression cylinder housing a second compression piston connected to the first crank shaft, wherein the second two-stroke compression cylinder is configured to provide compressed gas to the intermediate two-stroke compression cylinder; and a second four-stroke combustion cylinder housing a second combustion piston, wherein the second four-stroke combustion cylinder is configured to receive compressed gas from the intermediate two-stroke compression cylinder;

wherein each one of the intermediate compression piston and the first and second combustion pistons are connected to a second crank shaft, the second crank shaft being configured to rotate with a speed of at least twice the speed of the first crank shaft, wherein the first compression piston and the second compression piston are arranged in a 180 degrees crank angle offset in relation to each other, such that the first compression piston is configured to reach an upper end position within the first compression cylinder when the second compression piston reaches a lower end position within the second compression cylinder.

2. The internal combustion engine according to claim 1, wherein the first combustion piston and the second combustion piston are positioned to reach an upper end position within the respective combustion cylinder approximately simultaneously and in such a way that the first combustion piston is configured to be ignited at an upper end position within the first combustion cylinder when the second combustion piston is in an upper end position of the second combustion cylinder for initiation of intake of fuel therein.

3. The internal combustion engine according to claim 1, wherein each of the cylinders comprises valved inlet ports and valved outlet port for controlling fluid transportation into and out from the respective cylinders.

4. The internal combustion engine according to claim 1, wherein each one of the first and second compression cylinders are arranged in fluid communication with the intermediate compression cylinder by means of a respective first and second passageway.

5. The internal combustion engine according to claim 4, wherein each of the first, second, third and fourth passageways are provided with cooling means for cooling the fluid passing there through.

6. The internal combustion engine according to claim 1, wherein the intermediate compression cylinder is in fluid communication with the first and second combustion, cylinders by means of a respective third and fourth passageway.

7. The internal combustion engine according to claim 1, wherein the first compression cylinder and the second compression cylinder are one and the same compression cylinder, and the first compression piston and the second compression piston are one and the same compression piston, wherein the compression cylinder is configured to provide a first compression when the compression piston reaches an upper position within the compression cylinder, and to provide a second compression when the compression piston reaches a lower position within the compression cylinder.

8. A vehicle comprising the internal combustion as claimed in claim 1.

9. An internal combustion engine comprising a first set of cylinders comprising:

a first two-stroke compression cylinder housing a first compression piston connected to a first crank shaft;

an intermediate two-stroke compression cylinder housing an intermediate compression piston, wherein the intermediate two-stroke compression cylinder is configured to receive compressed gas from the first two-stroke compression cylinder; and a first four-stroke combustion cylinder housing a first combustion piston, wherein the first four-stroke combustion cylinder is configured to receive compressed gas from the intermediate two-stroke-compression cylinder;

wherein the internal combustion engine further comprises a second set of cylinders comprising:

a second two-stroke compression cylinder housing a second compression piston connected to the first crank shaft, wherein the second two-stroke compression cylinder is configured to provide compressed gas to the intermediate two-stroke compression cylinder; and a second four-stroke combustion cylinder housing a second combustion piston, wherein the second four-stroke combustion cylinder is configured to receive compressed gas from the intermediate two-stroke compression cylinder;

wherein each one of the intermediate compression piston and the first and second combustion pistons are connected to a second crank shaft, the second crank shaft being configured to rotate with a speed of at least twice the speed of the first crank shaft, and further comprising:

a first two-stroke expansion cylinder housing a first expansion piston connected to the first crank shaft, the first two-stroke expansion cylinder being configured to receive exhaust gas from the first four-stroke combustion cylinder; and a second two-stroke expansion cylinder housing a second expansion piston connected to the first crank shaft, the second two-stroke expansion cylinder being configured to receive exhaust gas from the second four-stroke combustion cylinder.

10. The internal combustion engine according to claim 9, wherein the first expansion piston and the second expansion piston are arranged in a 180 degrees crank angle offset in relation to each other, such that the first expansion piston is configured to reach an upper end position within the first expansion cylinder when the second expansion piston reaches a lower end position within the second expansion cylinder (114.

11. The internal combustion engine according to claim 9, wherein the first expansion piston and the first compression piston are arranged in a 90 degrees crank angle offset in relation to each other, such that the first compression piston is configured to reach an upper end position within the first compression cylinder when the first expansion piston is located in a mid-portion within the first expansion cylinder.

12. The internal combustion engine according to claim 9, wherein a first and a second compression con rod is connected to the first and second compression piston, respectively, and a first and a second expansion con rod is connected to the first and second expansion piston, respectively, wherein the first compression con rod and the first expansion con rod is connected to a first crank pin of the first crank shaft, and wherein the second compression con rod and the second expansion con rod is connected to a second crank pin of the first crank shaft.

13. The internal combustion engine according to claim 9, wherein the first and second compression cylinders are positioned in parallel in relation to each other and the first and second expansion cylinders are positioned in parallel in relation to each other, wherein the compression cylinders and the expansion cylinders are arranged in a V-shaped configuration in relation to each other.

14. The internal combustion engine according to claim 9, wherein the first combustion cylinder is in fluid communication with the first expansion cylinder by means of a fifth passageway.

15. The internal combustion engine according to claim 9, wherein the second combustion cylinder is in fluid communication with the second expansion cylinder by means of a sixth passageway.

16. An internal combustion engine comprising a first set of cylinders comprising:

a first two-stroke compression cylinder housing a first compression piston connected to a first crank shaft;

an intermediate two-stroke compression cylinder housing an intermediate compression piston, wherein the intermediate two-stroke compression cylinder is configured to receive compressed gas from the first two-stroke compression cylinder; and a first four-stroke combustion cylinder housing a first combustion piston, wherein the first four-stroke combustion cylinder is configured to receive compressed gas from the intermediate two-stroke-compression cylinder;

wherein the internal combustion engine further comprises a second set of cylinders comprising:

a second two-stroke compression cylinder housing a second compression piston connected to the first crank shaft, wherein the second two-stroke compression cylinder is configured to provide compressed gas to the intermediate two-stroke compression cylinder; and a second four-stroke combustion cylinder housing a second combustion piston, wherein the second four-stroke combustion cylinder is configured to receive compressed gas from the intermediate two-stroke compression cylinder;

wherein each one of the intermediate compression piston and the first and second combustion pistons are connected to a second crank shaft, the second crank shaft being configured to rotate with a speed of at least twice the speed of the first crank shaft, and wherein the intermediate compression piston and the first combustion piston are arranged in a 180 degrees crank angle offset in relation to each other, such that the intermediate compression piston is configured to reach an upper en position within the intermediate compression cylinder when the first combustion piston reaches a lower end position within the first combustion cylinder.

* * * * *